US005297831A

United States Patent [19]

Bakker

[11] Patent Number: 5,297,831

[45] Date of Patent: Mar. 29, 1994

[54] PINCER GRAB

[75] Inventor: Harm Bakker, Huissen, Netherlands

[73] Assignee: Bakker Hydraulic B.V., Netherlands

[21] Appl. No.: 761,683

[22] Filed: Sep. 18, 1991

[30] Foreign Application Priority Data

Jul. 23, 1991 [NL] Netherlands ..... 9101289
Aug. 8, 1991 [NL] Netherlands ..... 9101365

[51] Int. Cl.[5] ..... B66C 3/16
[52] U.S. Cl. ..... 294/68.23
[58] Field of Search ..... 294/68.23, 88, 106, 294/111, 112; 37/183 R-188; 414/624-626

[56] References Cited

FOREIGN PATENT DOCUMENTS 348010 12/1989 European Pat. Off. ..... 294/68.23

*Primary Examiner*—Johnny D. Cherry
*Attorney, Agent, or Firm*—Willian Brinks Hofer Gilson & Lione

[57] ABSTRACT

A pincer grab is provided having a frame, two jaws pivotally mounted to the frame which can come together and form a grab, a hydraulic drive cylinder, and transmission between the drive unit and the jaws. The hydraulic cylinder is coupled at both ends using U-shaped coupling members, via pivot joints, to two respective pairs of transmitting arms, each connected to a jaw. The transmission is substantially free of residual stresses.

10 Claims, 2 Drawing Sheets

PINCER GRAB

The invention relates to a pincer grab, comprising:

a frame with attaching means for coupling to a hoisting device;

two jaws carried by that frame pivotably round mutually parallel horizontal centre lines, which jaws have complementary edges facing one another and which can together form a grab;

a hydraulic drive cylinder with coupling means for coupling to a controllable source for medium under pressure, the ends of which drive cylinder are coupled by means of two more or less U-shaped coupling members via pivot joints to two respective pairs of transmitting arms, each connected to a jaw; and transmission means arranged between the drive unit and the jaws;

wherein the disposition is such that through suitable energizing of the drive unit the jaws can be moved between the closed position, wherein they together form a grab, and an open position.

Known from applicant's European patent application EP-A-0 348 010 is a pincer grab, wherein the transmission means comprise U-shaped coupling members comprising two metal strips bent more or less into a U-shape, wherein the body of the U is fixed to fixing sleeves at both ends of the cylinder and the ends of the legs of the U are fixedly welded to the said pivot joints. It cannot be wholly prevented during assembly of such a pincer grab that certain residual stresses remain present in the transmission strip embodied as one entity. As a consequence of these residual stresses the total force exerted on a strip during the transfer of forces can be greater than intended, which is undesired. The residual stress can also result in a tendency to deviation from the correct aligning of aligned pivot joints.

The invention has for its object to embody a pincer grab such that no residual stresses can be present in the transmission means. For this purpose the pincer grab according to the invention has the feature that each coupling member comprises a block coupled to the relevant end of the cylinder, to which block are fixed two rods forming the legs of the U.

Very simple and reliable is a pincer grab having the feature that the rods are fixedly welded to the block.

In order to obtain the best possible force transmission with minimum stress in the material the pincer grab according to the invention preferably has the feature that the block has a recess with a shape adapted to the shape of the relevant end of the rod.

The invention will now be elucidated with reference to the annexed drawing, in which is shown among other things an embodiment of the device according to the invention. In the drawing.

Figure 1:
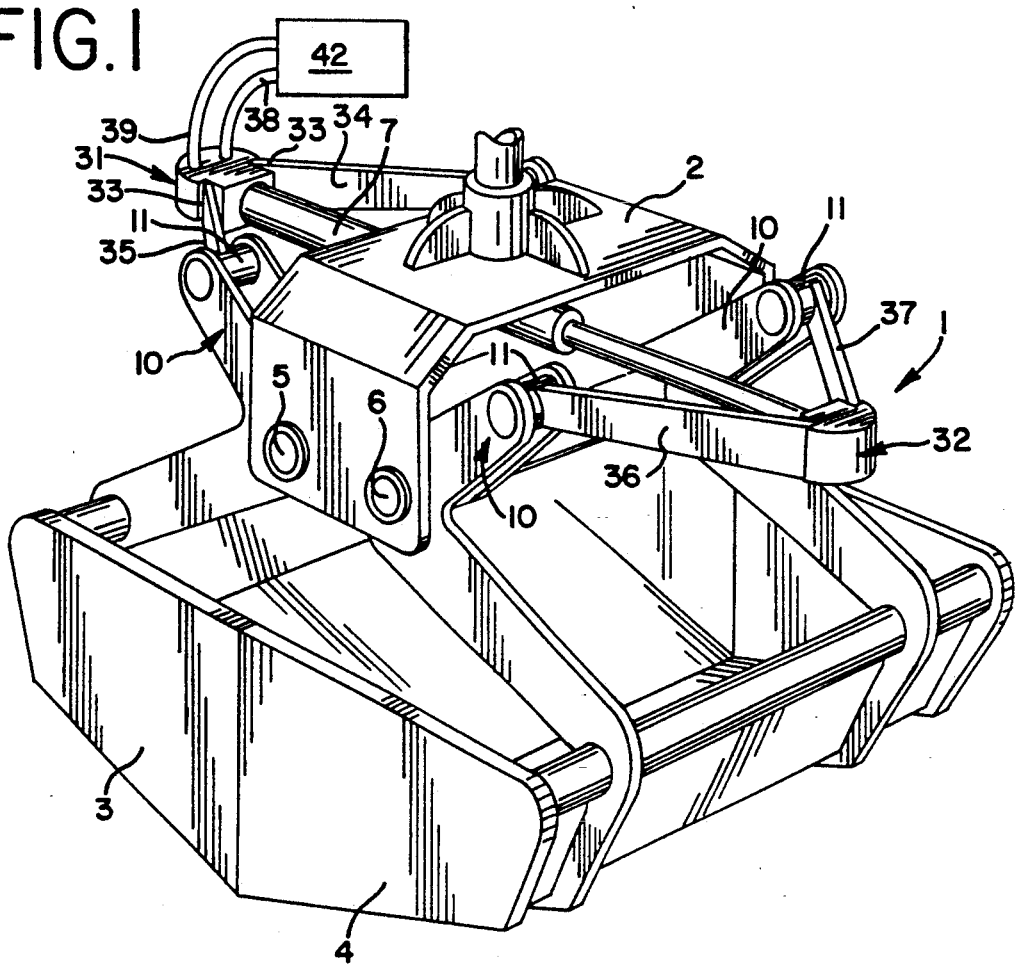
FIG. 1 shows a perspective view of a pincer grab according to the invention.
Figure 2:
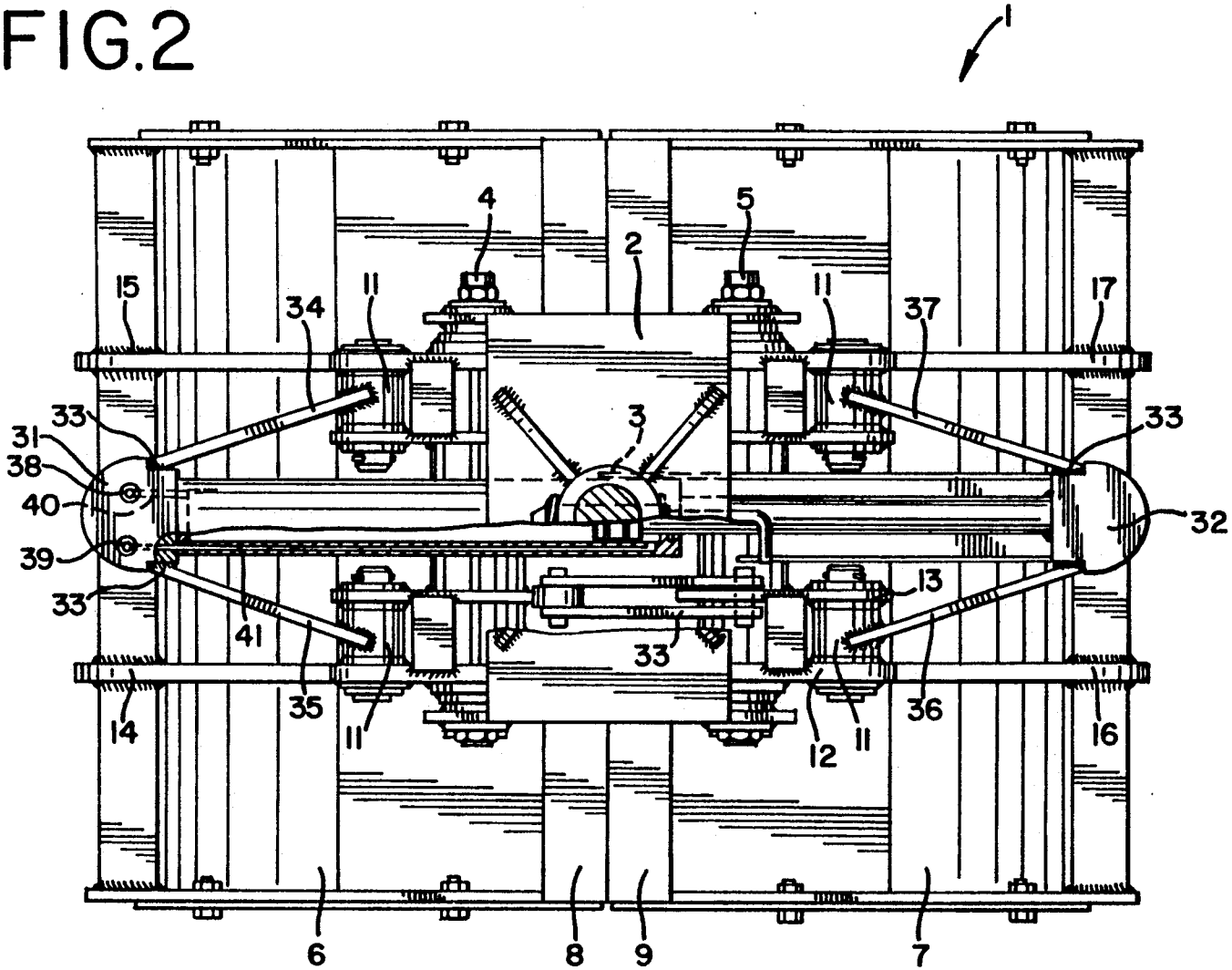
FIG. 2 shows a partly broken away top view of a pincer grab.

FIG. 1 shows a pincer grab 1. This comprises a frame 2 carried by bearing means (not shown), to which frame two jaws 3, 4 are pivotally connected. It should be noted that the two jaws 3, 4 have edges which are complementary with respect to each other when the two jaws 3 and 4 are in a closed position, as shown in FIGS. 1 and 2. Designated with 5 and 6 are the pivot joints on the visible side. A hydraulic cylinder 7, which is connected by way of means (not shown) to a drive unit 42, such as a controllable pressure source, transfers via force transmitting rods 34, 35, 36, 37 the generated force to all arms designated 10 which are rigidly coupled to the jaws 3, 4. For this purpose the brackets 8, 9 are welded fixedly to sleeves 11 which engage around pivot shafts (not shown) which are in turn joined to the arms 10. In this manner the brackets 8, 9 are pivotally coupled to the arms 10.

FIG. 2 shows a top view of a pincer grab with the same basic construction as that of the pincer grab according to FIG. 1.

As shown in FIGS. 1 and 2, the hydraulic cylinder bears at both its ends a block 31, 32 with a semi-circular outer surface connecting onto two recesses, each designated 33. Into these recesses fit the ends of respective rods 34, 35, 36, 37 which are welded fixedly on one side to the blocks 31, 32 and on the other to the sleeves 11 which form the components of the pivot joints furthest to the outside.

Discussed hereinafter is the manner in which assembly of a pincer grab according to the invention can take place.

Figure 3:
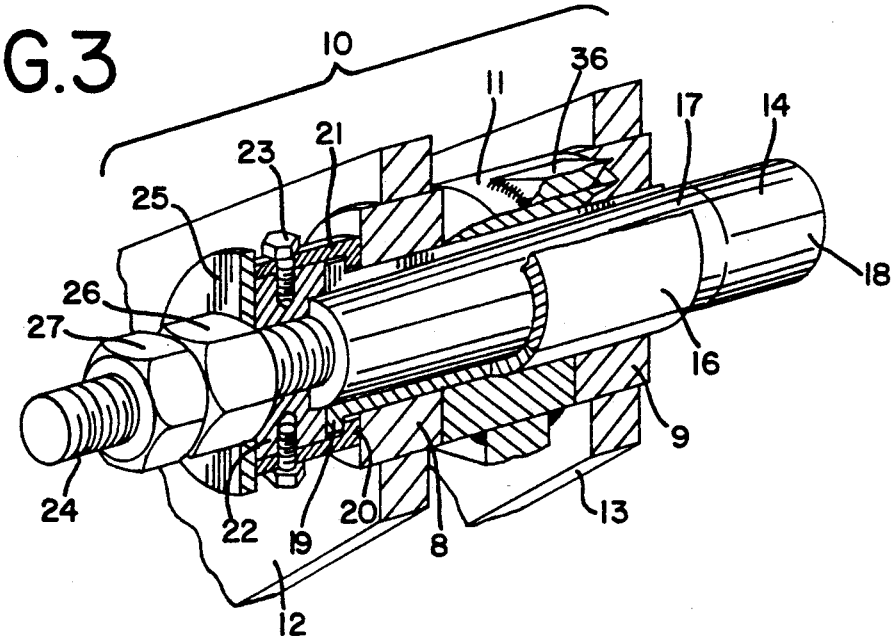
FIG. 3 shows a partly broken away, perspective view of an expandable mandrel for correctly aligning the components for a pivot joint of a pincer grab.

FIG. 3 shows the manner in which the arms 10 assembled from two plate parts 12, 13 are mutually fixed for mounting by means of the device according to the invention. As the figure shows, the device 14 is inserted into the through-holes in the respective components, namely the plate parts 12, 13 and the sleeve 11. The device 14 comprises a jacket cons . of three jacket parts 16 separated in lengthwise direction. The outer surfaces of these jacket parts 16 have the form of a portion of a cylinder jacket, in any case a fluent, rounded form. The inner surfaces of the jacket parts 16 have a substantially conical shape which is adapted to the conical shape of the active surface 17 of the core 18. The jacket parts have at one end an external flange 19 which co-acts with an internal flange 20 of the locking ring 21. A ring 22 can be fastened to this locking ring 21 by means of bolts 23. The core has on its end a threaded end 24 which protrudes through the ring 22 and which extends further through a supporting ring 25 and finally co-acts with nuts 26, 27.

When in the situation drawn in FIG. 2 the nut 26 is rotated such that the core 18 is displaced to the left in the drawing, the outer surface 17 of core 18 will slide relative to the inner surfaces of the jacket parts 16 whereby these move outward. This results in a fixed clamping of the device 14 in the relevant holes such that the components in question are precisely fixed relative to each other. Thus achieved is that fixed welding of the components can take place with an accurately determined mutual positioning. Finishing operations are hereby no longer necessary.

Attention is drawn to the fact that it can be advantageous when four devices 14 as according to FIGS. 2, 3 are employed for assembling the device 1 of FIG. 1, and particularly when the pivot joints aligned with each other are formed by two devices 14 mutually aligned in a mould. This greatly improves the production speed and accuracy of alignment.

The pincer grab according to the invention can best be manufactured by first fixedly welding to each rod 34–37 the sleeve 11 as a component of a pivot joint, subsequently assembling and, by means of the device 14 according to FIG. 3, placing and holding in mutually correct positions all the components forming the pivot joints with correct aligning of pivot joints with a common pivot centre line, placing the drive cylinder 7 to which the blocks 31, 32 are fixed in advance, wherein the positioning takes place such that the relevant ends of the rods 34–37 can be placed in the recesses 33 and be fixedly welded on the blocks 31, 32, fixedly welding the relevant ends of the rods 34–37 on the blocks 31, 32 and, finally, removing the aligning devices 14 with which all four pivot joints are correctly aligned simultaneously.

The block 31 supports the hydraulic connections 38, 39 connected to drive unit 42. The hydraulic conduit 40 joined to the connection 38 extends through the block 31, while the second hydraulic conduit 41 extends to the connection 39 on the outside of the cylinder 7.

Attention is drawn to the fact that the manner of assembly according to the invention is not limited to coupling of the transmission means to pivot joints. The invention is equally applicable for other constructions, for example with a linear displacement.

I claim:

1. A pincer grab, comprising:

a frame with a pivot joint;

a first jaw pivotably mounted by said pivot joint, wherein said first jaw comprises two arms;

a U-shaped coupling member comprising legs and a block, wherein said legs comprise two force transmitting rods which are separate from one another and are each coupled to said block;

said two force transmitting rods pivotably connected to a corresponding arm of said first jaw;

a second jaw mounted to said frame and facing said first jaw;

a drive cylinder coupled to said block; and a drive unit coupled to said drive cylinder, wherein activation of aid drive unit results in said drive cylinder imparting a force on said block which in turn results in said two force transmitting rods pivoting said first jaw from an open position in which said first and said second jaws are not in contact to a closed position in which said first and said second jaws are in contact with one another.

2. The pincer grab of claim 1, wherein said second jaw comprises a complementary edge facing said first jaw when the first and second jaws are in said closed position.

3. The pincer grab of claim 1, wherein said second jaw is coupled to said drive cylinder so as to move from said open position to said closed position.

4. The pincer grab of claim 3, wherein said second jaw is pivotably mounted about a first horizontal center line.

5. The pincer grab of claim 4, wherein said first jaw is pivotably mounted about a second horizontal center line.

6. The pincer grab of claim 5, wherein said first horizontal center line is parallel to said second horizontal center line.

7. The pincer grab of claim 1, wherein said two force transmitting rods are welded to said block.

8. The pincer grab of claim 7, wherein said block comprises two recesses wherein each recess engages a corresponding one of said two force transmitting rods.

9. The pincer grab of claim 1, wherein said block comprises two recesses wherein each recess engages a corresponding one of said two force transmitting rods.

10. The pincer grab of claim 1, wherein said first jaw is pivotably mounted about a horizontal center line.

* * * * *

UNITED STATES PATENT AND TRADEMARK OFFICE

CERTIFICATE OF CORRECTION

PATENT NO. : 5,297,831
DATED : March 29, 1994
INVENTOR(S) : Harm Bakker

It is certified that error appears in the above-indentified patent and that said Letters Patent is hereby corrected as shown below:

In column 2, line 33, delete "cons." and substitute --consisting--.

Col. 4, In Claim 1, line 15, delete "aid" and substitute --said--.

Signed and Sealed this

Eleventh Day of October, 1994

*Attest:*

*Attesting Officer*

BRUCE LEHMAN

*Commissioner of Patents and Trademarks*